US011787014B2

(12) United States Patent
Chang

(10) Patent No.: US 11,787,014 B2
(45) Date of Patent: Oct. 17, 2023

(54) VICE JAW DEFLECTING STRUCTURE

(71) Applicant: Chun-Wei Chang, New Taipei (TW)

(72) Inventor: Chun-Wei Chang, New Taipei (TW)

( * ) Notice: Subject to any disclaimer, the term of this patent is extended or adjusted under 35 U.S.C. 154(b) by 177 days.

(21) Appl. No.: 17/352,392

(22) Filed: Jun. 21, 2021

(65) Prior Publication Data

US 2022/0371161 A1 Nov. 24, 2022

(30) Foreign Application Priority Data

May 19, 2021 (TW) ..... 110205736

(51) Int. Cl.
*B25B 1/24* (2006.01)
*B25B 1/02* (2006.01)
*B25B 1/10* (2006.01)

(52) U.S. Cl.
CPC ..... *B25B 1/241* (2013.01); *B25B 1/02* (2013.01); *B25B 1/10* (2013.01); *B25B 1/2405* (2013.01); *B25B 1/2478* (2013.01); *B25B 1/2484* (2013.01); *B25B 1/2489* (2013.01)

(58) Field of Classification Search
CPC .. B25B 1/103; B25B 1/02; B25B 1/10; B25B 1/2478; B25B 1/2405; B25B 1/2473; B25B 1/2489; B25B 1/241; B25B 1/2442
USPC ..... 269/136
See application file for complete search history.

(56) References Cited

U.S. PATENT DOCUMENTS

| | | | | |
|---|---|---|---|---|
| 5,114,126 | A * | 5/1992 | Yasue | B25B 1/106 269/136 |
| 6,012,712 | A * | 1/2000 | Bernstein | B25B 1/2405 269/254 CS |
| 11,383,354 | B1 * | 7/2022 | Taylor | B25B 1/2478 |
| 2021/0060733 | A1 * | 3/2021 | Lin | B25B 1/02 |
| 2022/0040819 | A1 * | 2/2022 | Thielges | B25B 1/2452 |
| 2022/0371160 | A1 * | 11/2022 | Chang | B25B 1/02 |

* cited by examiner

*Primary Examiner* — Mahdi H Nejad

(57) ABSTRACT

A vice jaw deflecting structure, comprising a vice main body, a lead screw positioning seat, a lead screw, a first flexible jaw set and a second flexible jaw set; the guide slot of the vice main body has a bottom surface, a first side wall surface, and a second side wall surface; the first flexible jaw set and the second flexible jaw set have a slide, a jaw and a limiting component; the slide is configured with a limiting block protruding toward the jaw, the limiting block protrudes toward the lead screw positioning seat and is formed with a ⟨-shaped stop block having a curved top view; the jaw bottom surface has a first convex wall surface and a second convex wall surface matching and contacting the first side wall surface and the second side wall surface.

4 Claims, 13 Drawing Sheets

VICE JAW DEFLECTING STRUCTURE

BACKGROUND OF INVENTION

1. Field of the Invention

The present invention relates generally to the technical field of vice jaws, and more particularly to a vice jaw deflecting structure.

2. Description of Related. Art

The basic structure of a common vice seen in the market mainly includes a fixed jaw configured on one end, and a flexible jaw configured on top of the vice, capable of sliding under the drive of a bolt. Thus, the work piece can be clamped between the fixed jaw and the flexible jaw for processing.

However, in the vices nowadays used by manufacturers to clamp work pieces to be processed, the two clamping surfaces of the fixed jaw and the flexible jaw are both rigid plane surfaces. Therefore, to clamp a work piece that has unparallel clamped surfaces on both sides, slight deflection may occur, leading to unstable clamping of the work piece. This is not good for subsequent processing. Hence, the current vice structure shall be improved.

In view of the above problem concerning the vice structure described above, it is the aim of the present invention to develop a vice jaw deflecting structure that enables left and right deflection of the jaw, so as to tightly push against the unparallel clamped surfaces of the work piece for stable clamping.

SUMMARY OF THE INVENTION

The object of the present invention is to provide a vice jaw deflecting structure capable of deflection to the left and right so that the non-parallel clamped surfaces of the processed parts fit and clamp, and the processed parts are firmly clamped.

In order to solve the above-mentioned problems and achieve the purpose of the present invention, the technical means of the present invention are achieved in the following way.

A vice jaw deflecting structure, comprising: a vice main body having a guide slot extending vertically; a lead screw positioning seat, configured in a center of the guide slot and having a lead screw positioning groove; a lead screw, a central ring of which is provided with a positioning portion, wherein the positioning portion is positioned at the lead screw positioning groove, and the two sides of the positioning portion are respectively configured with positive external spiral threads and reverse external spiral threads; and a clamping and fixing module, including a first flexible jaw set and a second flexible jaw set configured inside the guide slot of the vice main body, capable of sliding, wherein the first flexible jaw set has positive internal spiral threads designed to match the positive external spiral threads of the lead screw, the second flexible jaw set has reverse internal spiral threads designed to match the reverse external spiral threads of the lead screw, so that the first flexible jaw set and the second flexible jaw set will generate simultaneous clamping or releasing actions when the lead screw is rotated; wherein the guide slot has a bottom surface, a first side wall surface, a second side wall surface; the first flexible jaw set and second flexible jaw set both include a slide that can slide inside the guide slot configured on the vice main body, a jaw fitted on the slide, and a limiting component respectively configured on the left side wall and right side wall of the jaw; the slide is configured with limiting block protruding toward the jaw, the limiting block extends and protrudes toward the lead screw positioning seat to form a ⟨-shaped stop block having a curved top view; the bottom surface of the jaw has a first convex wall surface matching and contacting the first side wall surface, and a second convex wall surface matching and contacting the second side wall surface; the jaw of at least one of the first flexible jaw set or the second flexible jaw set has its first convex wall surface and first side wall surface contacting each other on a vertical line, and the second convex wall surface and the second side wall surface also contact each other on a vertical line, so that the jaw can deflect to the left or right, to be tightly pushed against the clamped surfaces of the work piece, and the work piece can be stably clamped.

More particularly, the vice jaw deflecting structure defined in claim 1, wherein, the bottom surface of the jaw is also configured with a slide chamber that can be fitted on the limiting block, for the jaw to be fixed on the slide.

More particularly, wherein, the front side inner wall and rear side inner avail of the slide chamber respectively have a ⟨-shaped containing groove to match the ⟨-shaped stop block, and the left side wall and right side wall of the jaw are respectively configured with a through hole that is communicated to the slide chamber.

More particularly, wherein the ⟨-shaped stop block is made up of a first slope (811) extending and protruding toward the lead screw positioning seat (2), and a second slope (812) configured in mirror symmetry relationship to the first slope, and the ⟨-shaped containing groove is made up of a first slope inner wall surface and a second slope inner wall surface configured to match the first slope and second slope. When the jaw is fitted on the slide, the ⟨-shaped stop block is housed inside the ⟨-shaped containing groove and the second slope is pushed against the second slope inner wall surface of the ⟨-shaped containing groove, so that the jaw can be fixed on the slide.

More particularly, wherein the limiting component is made up of a ball held inside the through hole, an elastic body pushed against the ball, and a screw locking component contacting the elastic body to press against the elastic body.

More particularly, wherein the left side wall and right side wall of the limiting block are both configured with a first embedding slot and a second embedding slot in upper and lower arrangements for the ball to slide in and be positioned inside.

More particularly, wherein the jaw is an integrally formed L-shaped seat, made up of a clamping seat to be fitted on the slide and a clamping block extending and protruding upward from one side of the clamping seat, and a notch is formed between the clamping block (66) and the clamping seat to hold the work piece.

Based on the above-mentioned technical implementation, the present invention has the following advantages comparing to the prior art:

1. Through the design of a ⟨-shaped stop block with a curved top view, the present invention enables the jaw to deflect to the left or right, so as to tightly clamp the work piece when the clamped surfaces of the work piece are not parallel. Thus, the work piece can be clamped stably for accurate tooling.

2. In the present invention, as the limiting component is configured inside the through holes on the left and right side walls of the jaw, the user can demount and replace the jaw simply by applying an upward force. Jaw replacement is very convenient. Also, through implementation of a protruding ⟨-shaped stop block on the limiting block, the user can easily mount the jaw on the limiting block. Thus, the jaw can be mounted onto the limiting block or demounted from the limiting block without the need to remove the bolts and pins. The present invention makes operation very easy and convenient and can enhance efficiency and increase capacity of production.

3. Through the design of the present invention to enable the ⟨-shaped stop block to push against the ⟨-shaped containing groove, when the jaw clamps the work piece, the ⟨-shaped stop block will push against the ⟨-shaped containing groove, and the jaw will generate a downward pressing force, so as to avoid fluctuation or upward floating of the work piece clamped by the jaw.

DETAILED DESCRIPTION OF THE INVENTION

Figure 1:
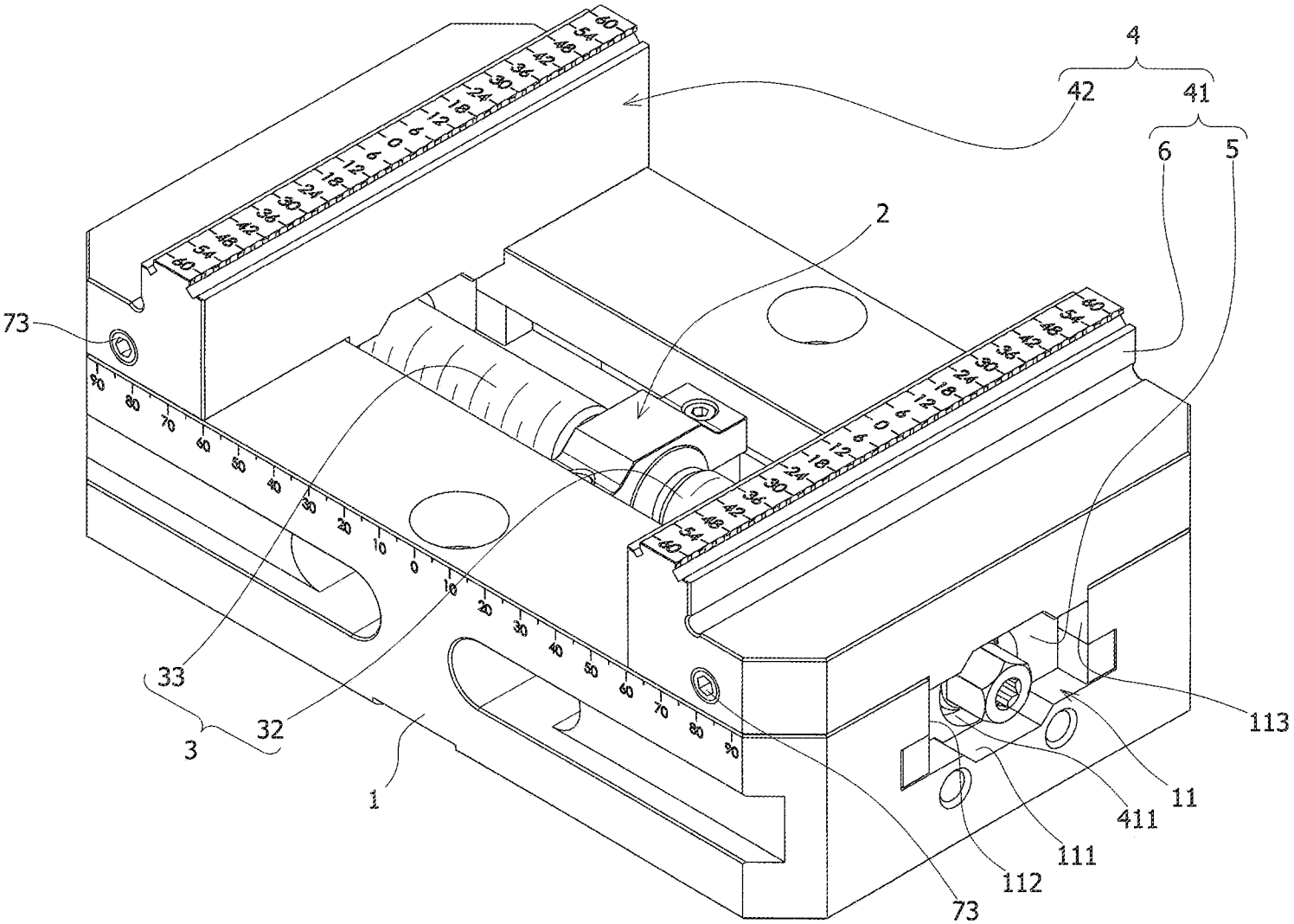
FIG. 1 is a perspective view of the present invention.
Figure 2:
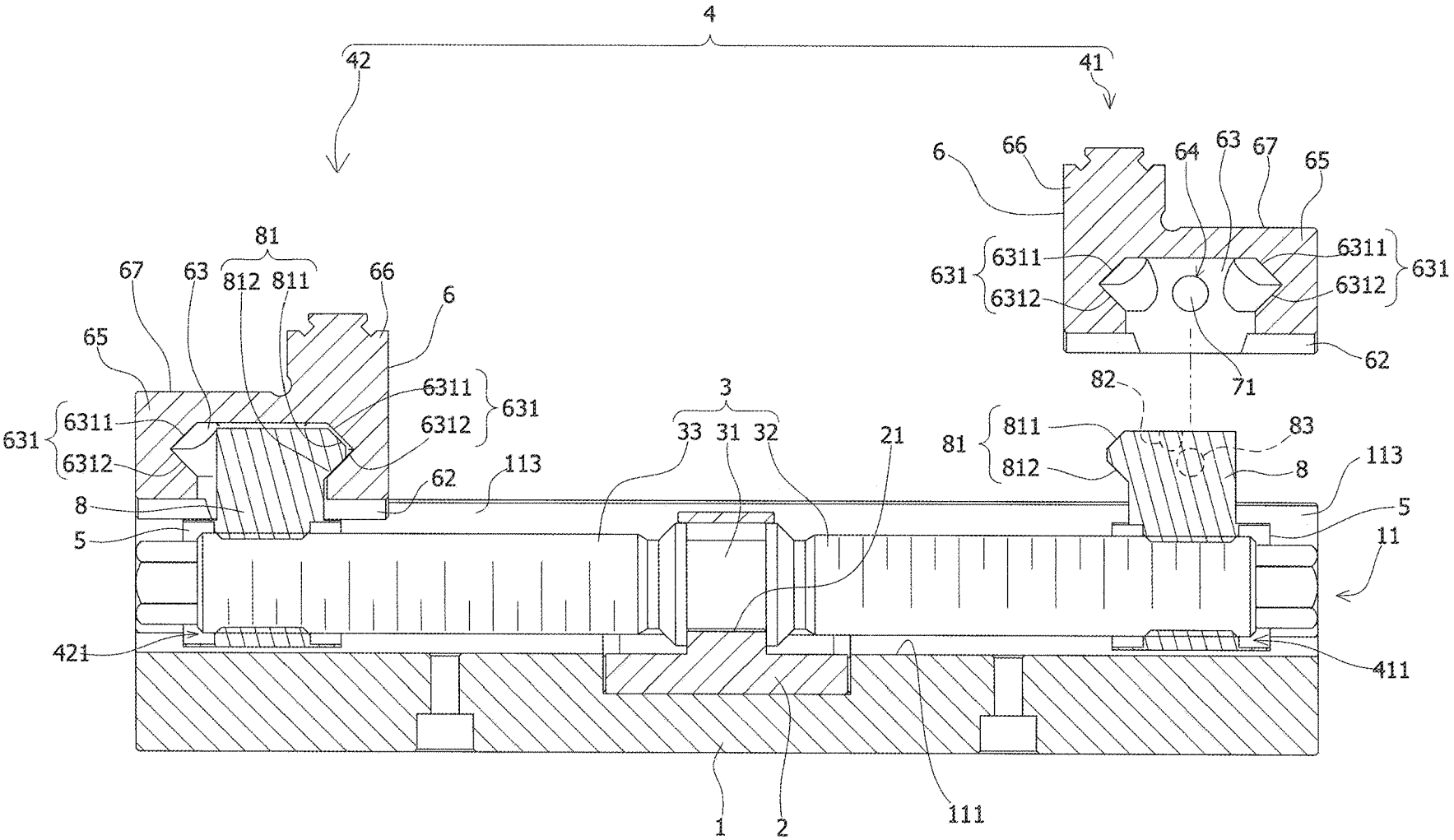
FIG. 2 is a sectional view of the present invention.
Figure 3:
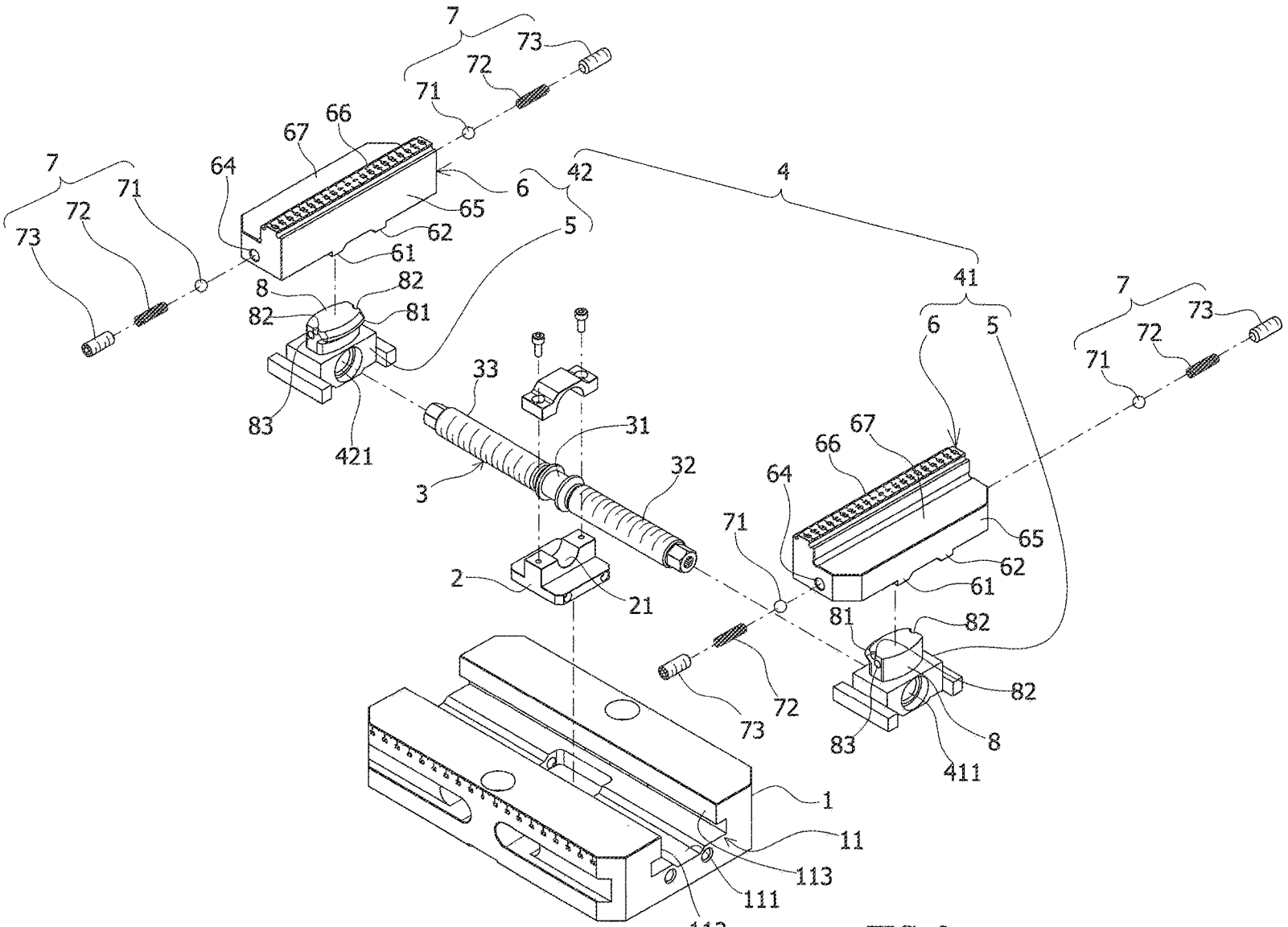
FIG. 3 is an exploded view of the present invention.
Figure 4:
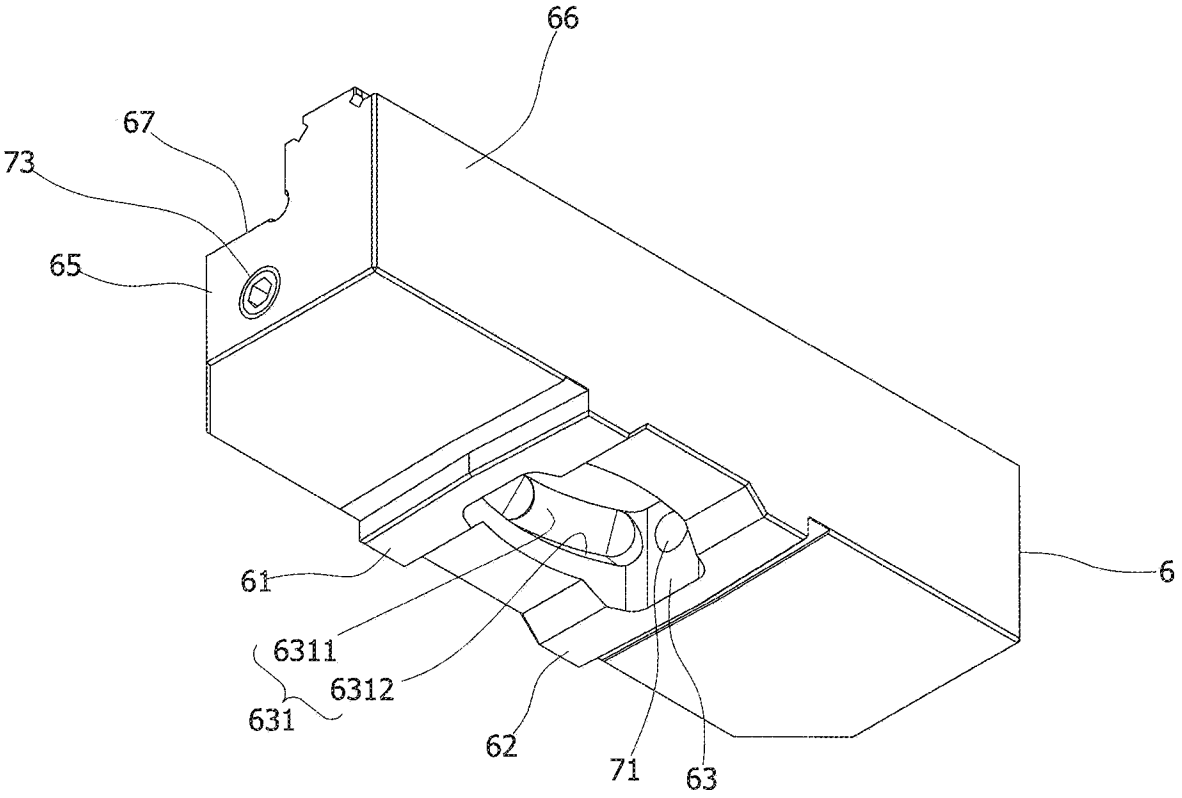
FIG. 4 is a perspective view of the jaw according to the present invention.
Figure 5:
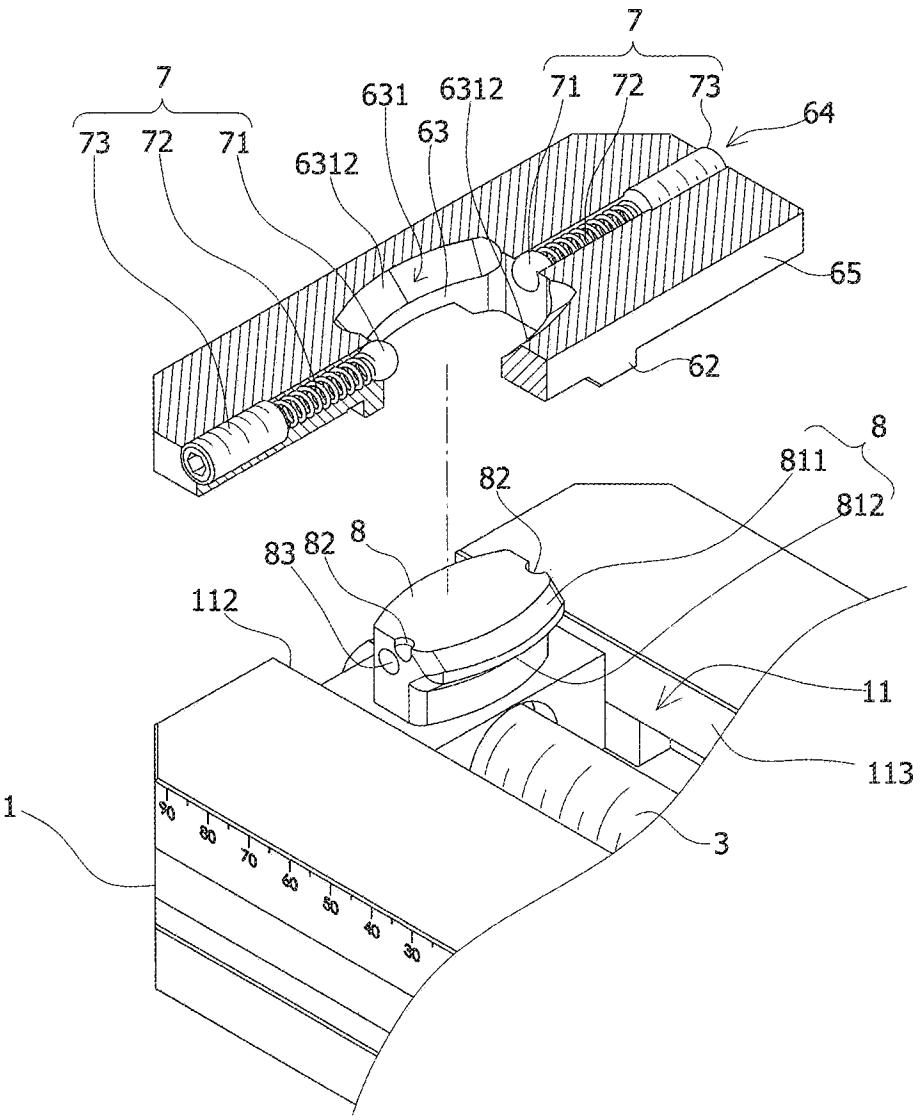
FIG. 5 is an implementation view of the jaw matching the limiting block according to the present invention.
Figure 6:
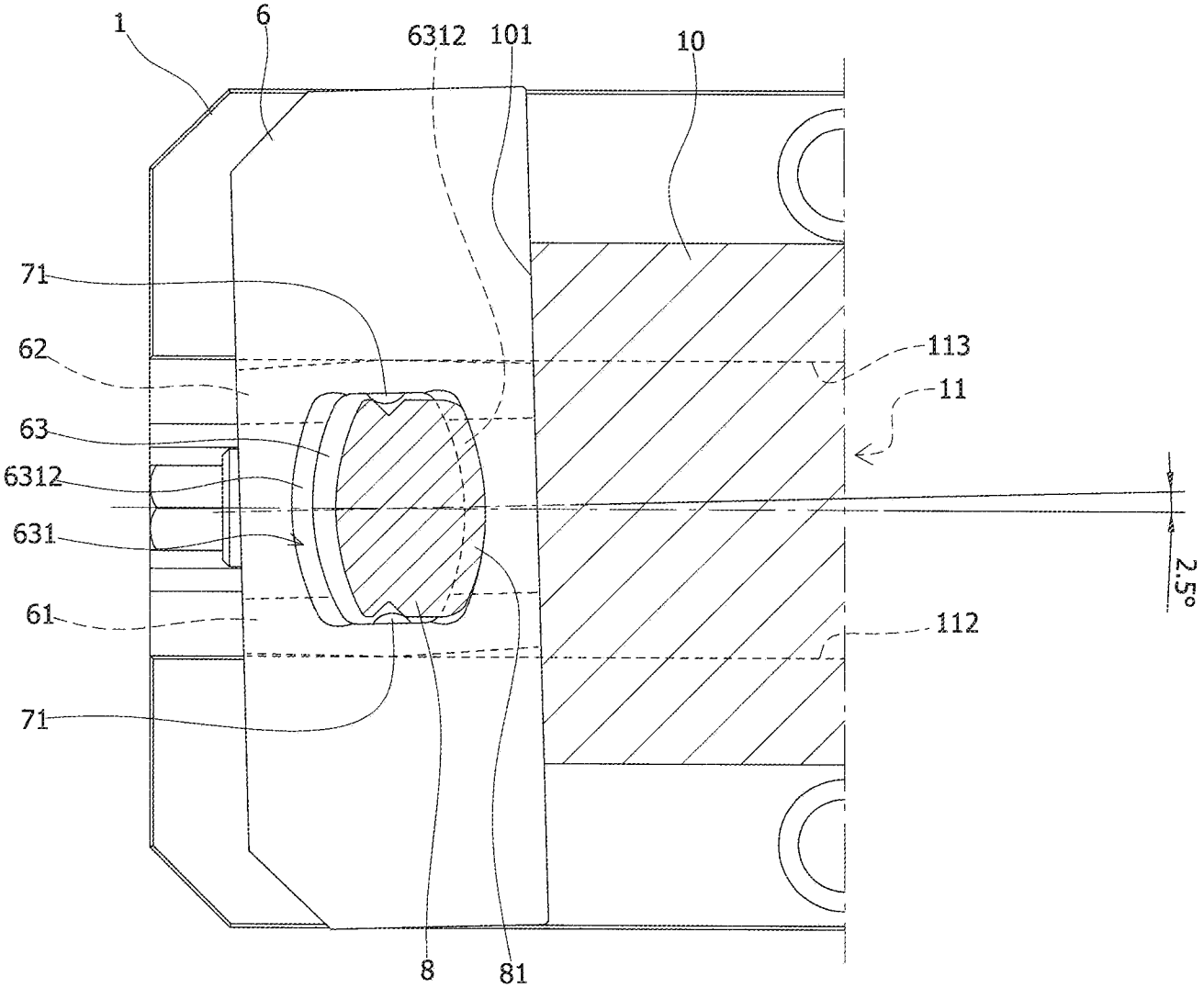
FIG. 6 is an implementation view of the present invention when the jaw deflects and tightly clamps the unparallel surfaces of the work piece.
Figure 7:
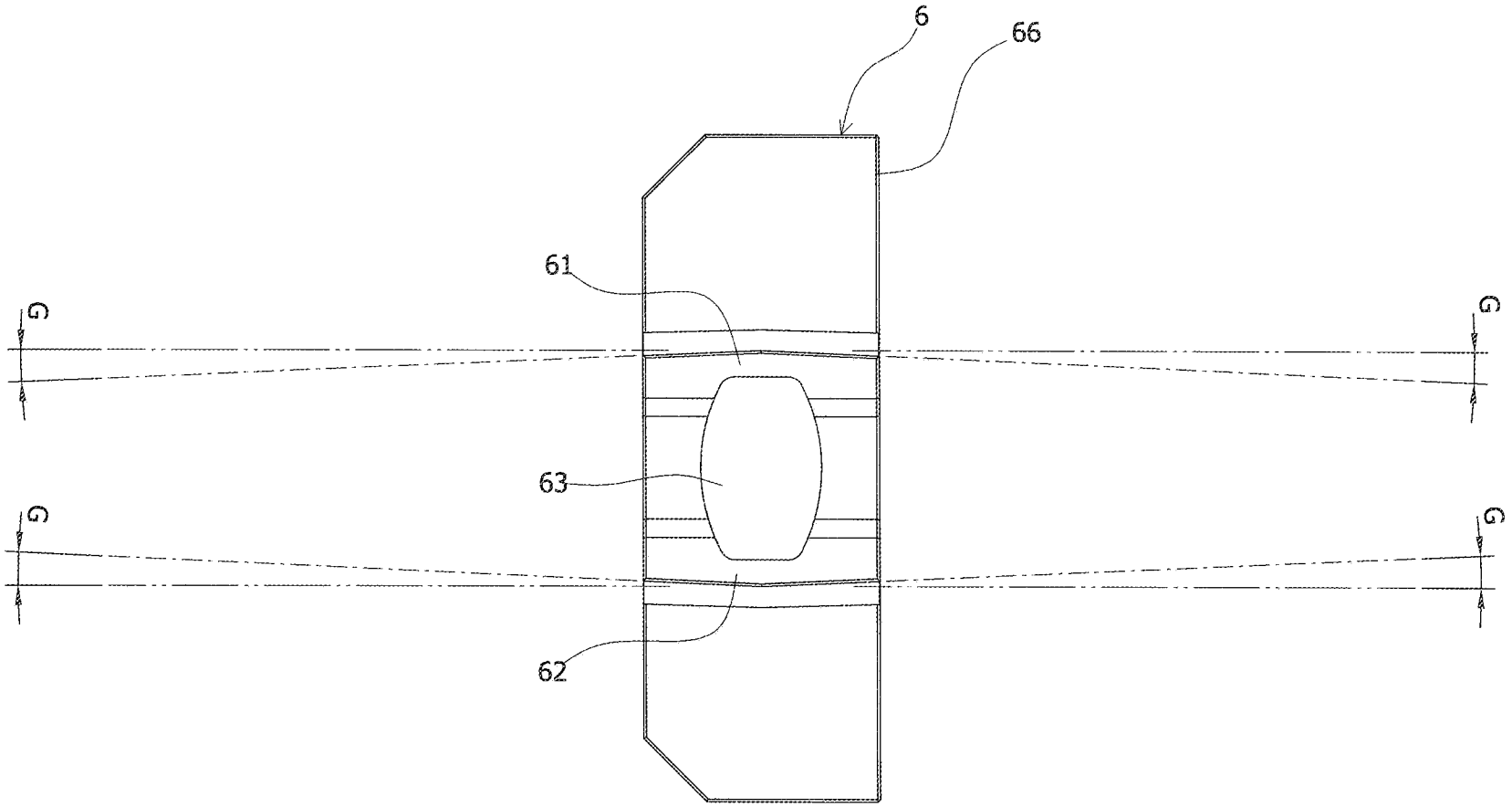
FIG. 7 is a schematic view of the present invention when the first and second convex wall surfaces contact the first and second side wall surfaces to form a gap.
Figure 8:
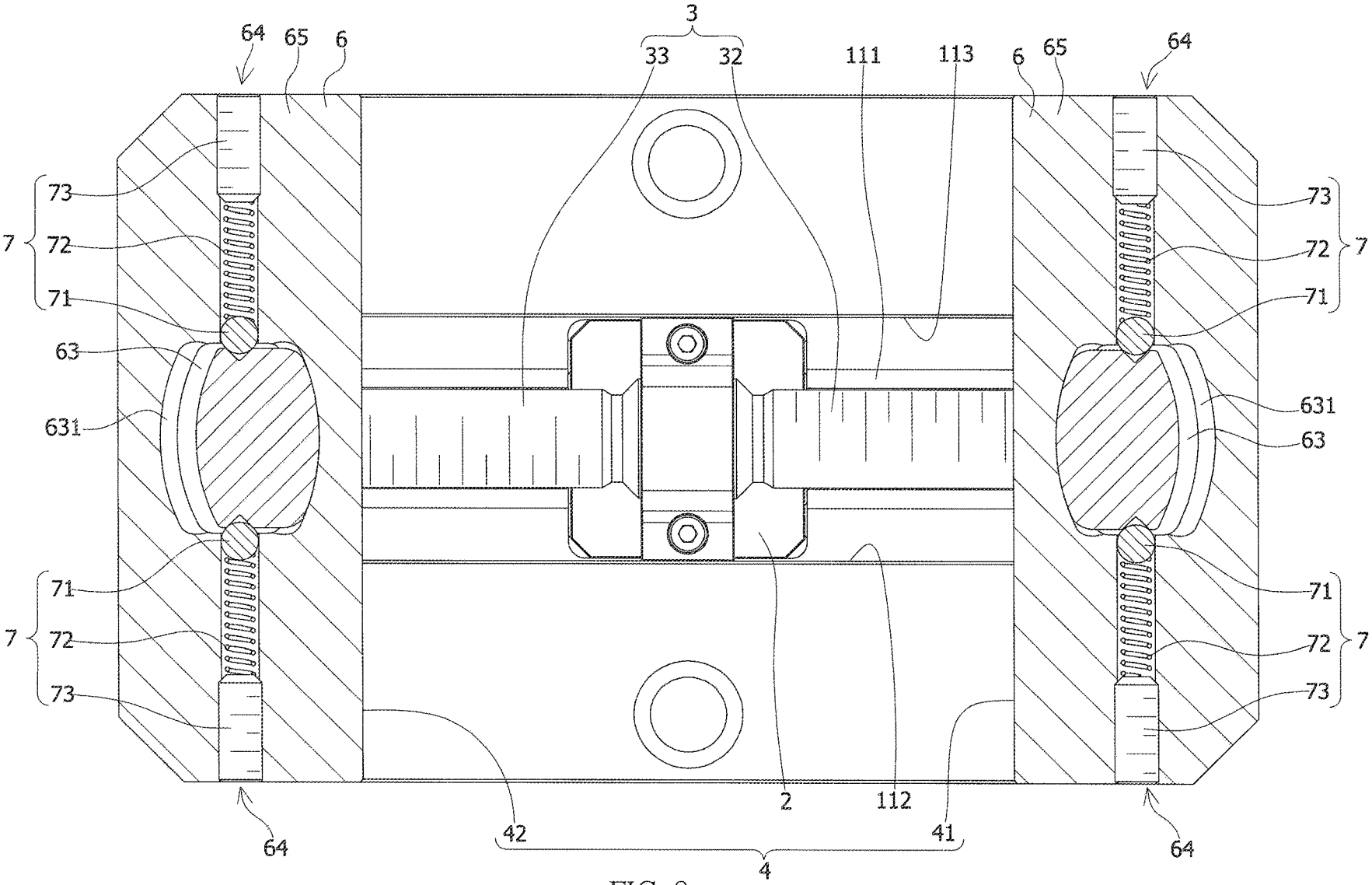
FIG. 8 is a sectional top view of the present invention.
Figure 9:
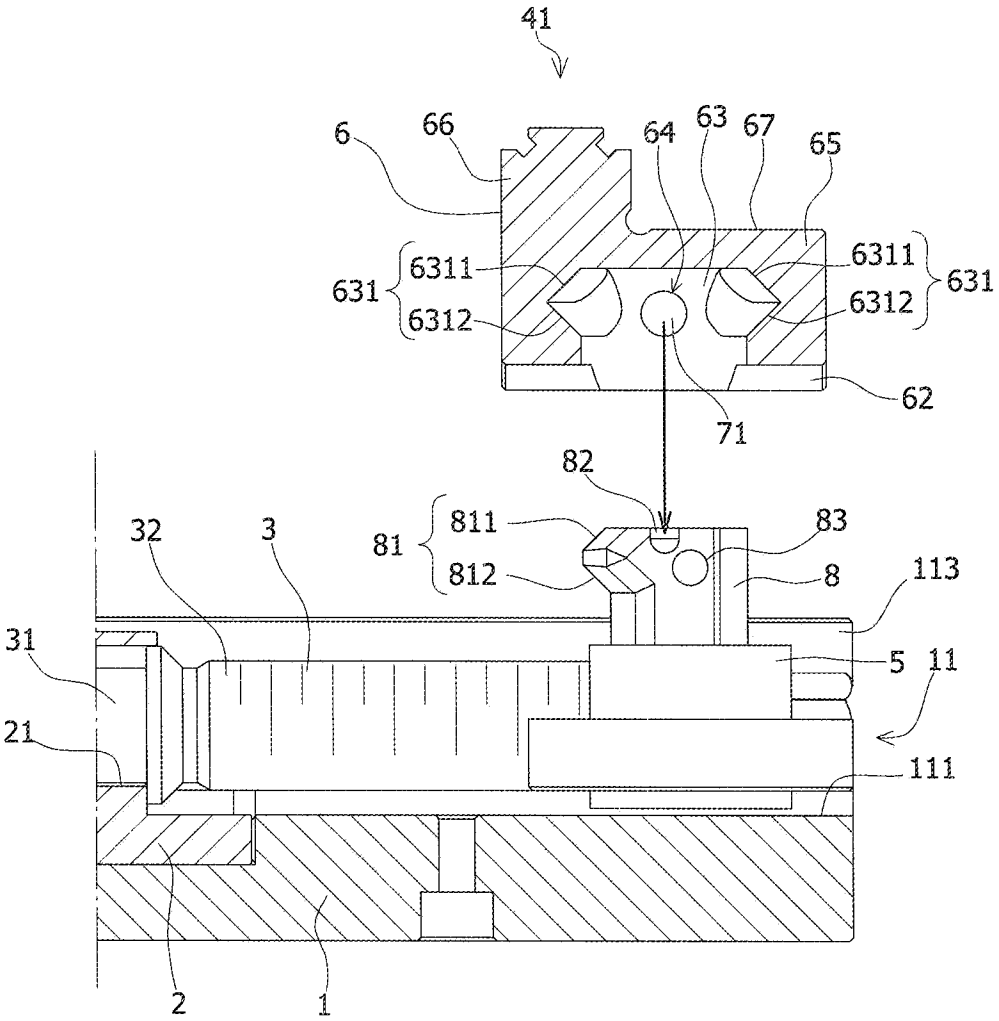
FIG. 9~FIG. 11 are partial sectional view of the present invention.
Figure 10:
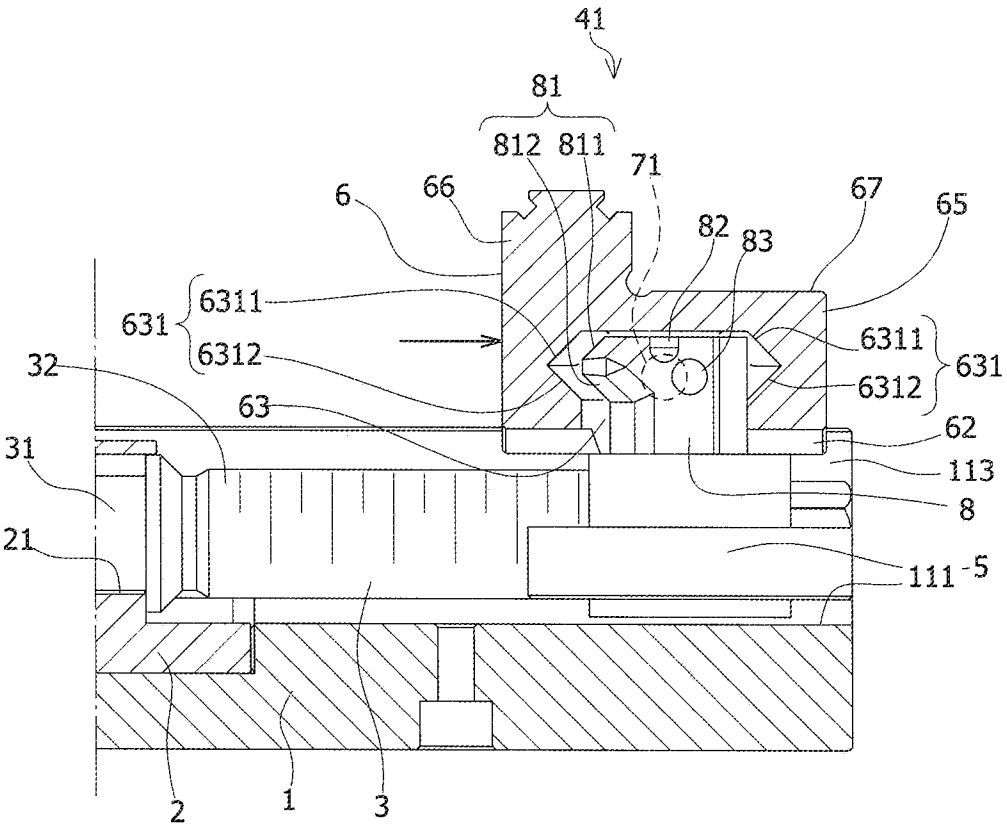

Below are detailed descriptions of the present invention with respect to the embodiments as disclosed in the figures/ FIG. 1 and FIG. 2 disclose a vice jaw deflecting structure, which comprises: a vice main body 1, having a guide slot 11 extending vertically; a lead screw positioning seat 2, configured in the center of the guide slot 11, having a lead screw positioning groove 21; a lead screw 3, with its center configured with a positioning portion 31 in a ring form, the positioning portion 31 being, positioned at the lead screw positioning groove 21, and the two sides of the positioning portion 31 are respectively configured with positive external spiral threads 32 and reverse external spiral threads 33; and a clamping and fixing module 4, comprising a first flexible jaw set 41 and a second flexible jaw set 42 configured inside the guide slot 11 of the vice main body 1, capable of sliding. The first flexible jaw set 41 has positive internal spiral threads 411 corresponding, to the positive external threads 32 of the lead screw 3, the second jaw set 42 has reverse internal spiral threads 421 corresponding to the reverse external threads 33 of the lead screw 3, so that the first jaw set 41 and the second jaw set 42 can generate simultaneous clamping or releasing actions along with the rotation of the lead screw 3.

The main technical features of the vice jaw deflecting structure according to the present invention are depicted in FIG. 3 through FIG. 7. The guide slot 11 has a bottom surface 111, a first side wall surface 112, a second side wall surface 113; the first flexible jaw set 41 and second flexible jaw set 42 both include a slide 5 that can slide inside the guide slot 11 configured on the vice main body 1, a jaw 6 that is fitted on the slide 5, and a limiting component 7 respectively configured on the left side wall and right side wall of the jaw 6; the slide 5 is configured with a limiting block 8 protruding toward the jaw 6, the limiting block 8 extends toward the lead screw positioning seat 2 and is formed with a ⟨-shaped stop block 81 having a curved top view; and the bottom surface of the jaw 6 has a first convex wall surface 61 matching and contacting the first side wall surface 112, and a second convex wall surface 62 matching and contacting the second side wall surface 113; the jaw 6 of at least one of the first flexible jaw set 41 or the second flexible jaw set 42 has its first convex wall surface 61 and first side wall surface 112 contacting each other on a vertical line, and the second convex wall surface 62 and the second side wall surface 113 also contact each other on a vertical line, so that a gap G is formed between the first convex wall surface 61 and the second convex wall surface 62, as well as between the first side wall surface 112 and the second side wall surface 113.

Thus, when the clamped surfaces 101 on the two sides of the work piece 10 are not parallel to each other, the design of the ⟨-shaped stop block Si and the gap G will enable the jaw 6 to deflect to the left or right for ±2.5 degrees with the lead screw 3 as the center point, so as to tightly contact the clamped surfaces 101 of the work piece 10. In this way, the work piece 10 can be stably clamped for accurate processing.

Referring to FIG. 8 through FIG. 12, the bottom surface of the jaw 6 is also configured with a slide chamber 63 that can be fitted inside the limiting block 8, for the jaw 6 to be fixed on the slide 5. The front side inner wall and rear side inner wall of the slide chamber 63 respectively has ⟨-shaped containing groove 631 configured to match the ⟨-shaped stop block 81, and the left side wall and right side wall of the jaw 6 are also configured with a through hole 64 that is communicated to the slide chamber 63; the ⟨-shaped stop block 81 is made up of a first slope 811 extending and protruding toward the lead screw positioning seat 2, and a second slope 812 configured in mirror symmetric relationship to the first slope 811 and the ⟨-shaped containing groove 631 is made up of a first slope inner wall surface 6311 and a second slope inner wall surface 6312 configured to match the first slope 811 and the second slope 812. When the jaw 6 is fitted on the slide 5, the ⟨-shaped stop block 81 is housed inside the ⟨-shaped containing groove 631 and the second slope 812 is pushed against the second slope inner wall surface 6312 of the ⟨-shaped containing groove 631, so that the jaw 6 is fixed on the slide 5.

Further, the limiting component 7 is configured inside the through hole 64 on the left and right side walls of the jaw 6. Thus, users can simply apply an upward force to demount and replace the jaw 6. The replacement can be operated easily. And through the application of the ⟨-shaped stop block 81, users can easily install the jaw 6 on the limiting block 8. Therefore, based on the design of the present invention, the jaw 6 can be mounted on the limiting block 8 or be demounted from the limiting block 8 without the need to disassemble the bolts and pins. It is convenient and practical, and can enhance work efficiency and increase production capacity.

Also, base on the application that the ⟨-shaped stop block 81 is pressed against the ⟨-shaped containing groove 631, when the jaw 6 clamps the work piece 10, the ⟨-shaped stop block 81 will push the ⟨-shaped containing groove 631, causing the second slope 812 to press the second slope inner wall surface 6312 downward to generate a downward force upon the jaw 6, so that fluctuation or upward floating can be avoided when the jaw 6 clamps the work piece 10.

Figure 11:
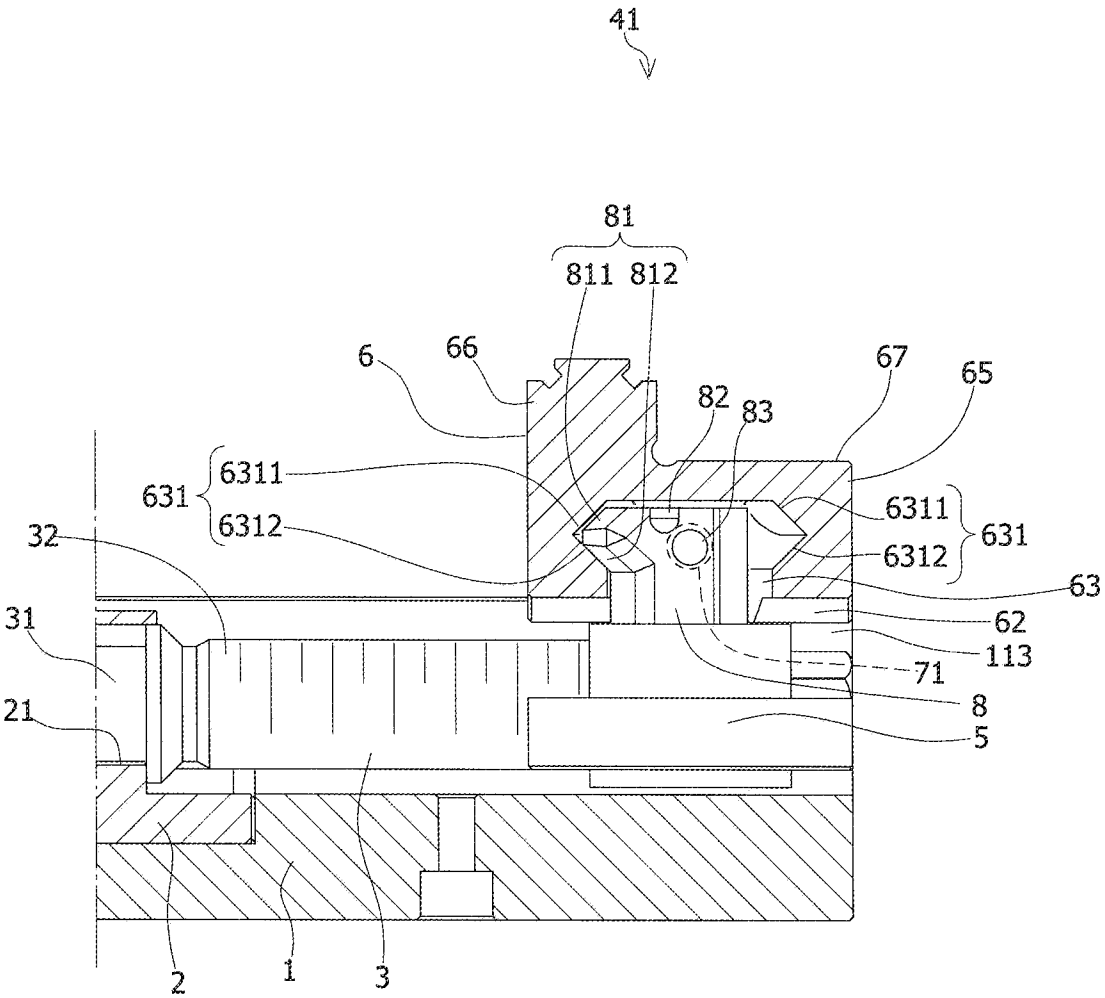
Figure 12:
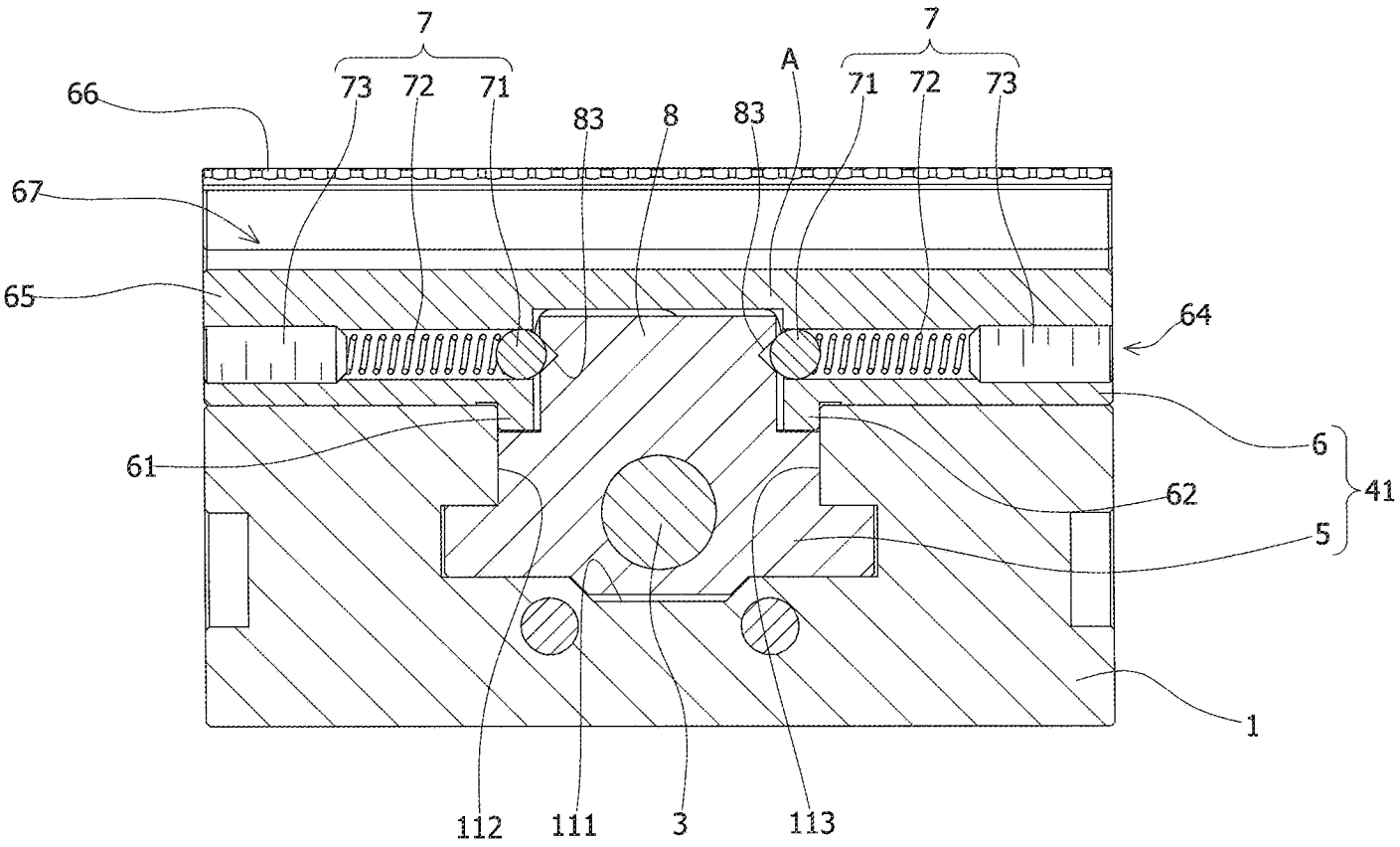
FIG. 12 is a sectional side view of the present invention.

As shown in FIG. 11 and FIG. 12, the limiting component 7 is made up of a ball 71 held inside the through hole 64, an elastic body 72 pressed against the ball 71, and a screw locking component 73 contacting the elastic body 72 to press against the elastic body 72. The ball 71 is fitted on the external edge of the through hole 64 and protrudes out of the through hole 64. The left side wall and right side wall of the limiting block 8 are both configured with a first embedding slot 82 and a second embedding slot 83 in upper and lower arrangements for the ball 71 to slide in and be fitted inside.

Based on such a structure, when the jaw 6 is mounted on the limiting block 8, the ball 71 slides from the left side wall and right side wall of the limiting block 8 toward the second embedding slot 83. When the ⟨-shaped stop block 81 is held inside the ⟨-shaped containing groove 631, the ball 71 is also just positioned at the second embedding slot 83 and is pressing against the second embedding slot 83, so that the jaw 6 is fixed on the slide 5; on the other hand, to demount the jaw 6 from the limiting block 8, the user just needs to slide the jaw 6 toward the guide slot 11, causing the ⟨-shaped containing groove 631 to be separated from the ⟨-shaped stop block 81, and the ball 71 is just at the first embedding slot 82 and is separated from the second embedding slot 83. At this time, the user just needs to push the jaw 6 upward to be removed from the limiting block 8.

Also, through the configuration of the elastic body 72, when the force to push the jaw 6 to the left or right disappears, it will be pulled back by the recovery force of the elastic body 72 to return to its original position. Thus, the jaw 6 can be fixed. Therefore, the present invention realizes quick recovery and positioning.

Figure 13:
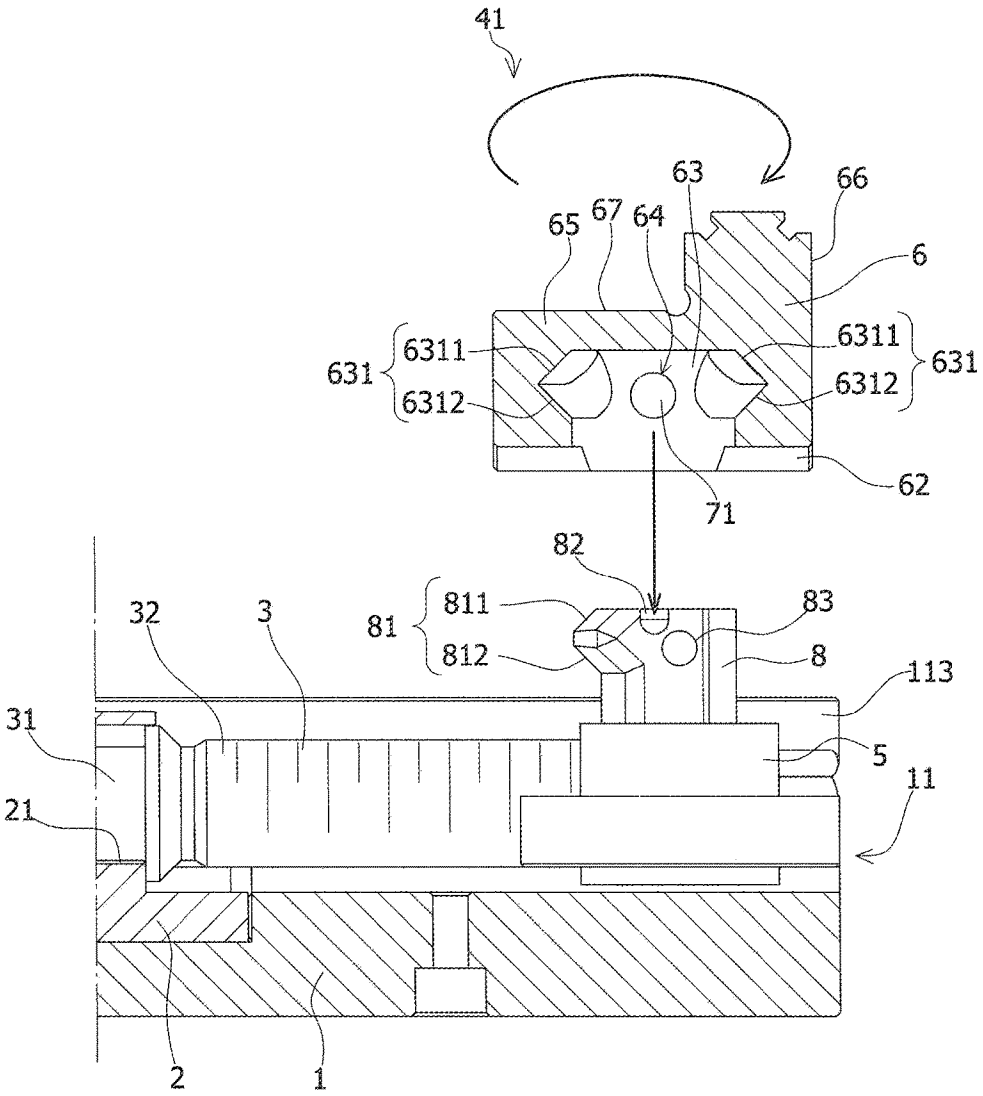
FIG. 13 is an implementation view of the present invention when the jaw is deflected.

As shown in FIG. 13, the jaw 6 is an integrally formed L-shaped seat, made up of a clamping seat 65 to be fitted on the slide 5, and a clamping block 66 extending and protruding from one side of the clamping seat 65. A notch 67 is formed between the clamping block 66 and the clamping seat 65 to hold the work piece [not shown in the figure]

Specifically, as the size of the work piece [not shown in the figure] is uncertain, through the design of the L-shape seat of the jaw 6, the jaw 6 can be mounted to match the work piece [not shown in the figure]. A small-size work piece [not shown in the figure] can be placed on the vice main body 1 to be clamped. In the case of a big-size work piece [not shown in the figure], by deflecting of the jaw 6, the work piece [not shown in the figure] can be placed at the notch 67 to be clamped. Thus, the relative position of the jaw 6 can be quickly adjusted to match the size of the work piece [not shown in the figure] to be clamped. Therefore, the present invention is practical and can meet the needs of industrial applications.

I claim:

1. A vice jaw deflecting structure, comprising:

a vice main body (1) having a guide slot (11) extending vertically;

a lead screw positioning seat (2), configured in a center of the guide slot (11) and having a lead screw positioning groove (21);

a lead screw (3), a central ring of which is provided with a positioning portion (31), wherein the positioning portion (31) is positioned at the lead screw positioning groove (21), and two sides of the positioning portion (31) are respectively configured with positive external spiral threads (32) and reverse external spiral threads (33); and a clamping and fixing module (4), including a first flexible jaw set (41) and a second flexible jaw set (42) configured inside the guide slot (11) of the vice main body (1), capable of sliding, wherein the first flexible jaw set (41) has positive internal spiral threads (411) designed to match the positive external spiral threads (32) of the lead screw (3), the second flexible jaw set (42) has reverse internal spiral threads (421) designed to match the reverse external spiral threads (33) of the lead screw (3), so that the first flexible jaw set (41) and the second flexible jaw set (42) will generate simultaneous clamping or releasing actions when the lead screw (3) is rotated;

wherein the guide slot (11) has a bottom surface (111), a first side wall surface (112), a second side wall surface (113);

the first flexible jaw set (41) and the second flexible jaw set (42) both include a slide (5) that can slide inside the guide slot (11) configured on the vice main body (1), a jaw (6) fitted on the slide (5), and a limiting component (7) respectively configured on a left side wall and a right side wall of the jaw (6);

the slide (5) is configured with limiting block (8) protruding toward the jaw (6), the limiting block (8) extends and protrudes toward the lead screw positioning seat (2) to form a V shaped stop block (81) having a curved top view;

a bottom surface of the jaw (6) has a first convex wall surface (61) matching and contacting the first side wall surface (112), and a second convex wall surface (62) matching and contacting the second side wall surface (113);

the first convex wall surface of the jaw of at least one of the first flexible jaw set or the second flexible law set contacting the first side wall surface of the guide slot of the vice main body on a vertical line, and the second convex wall surface of the jaw of the at least one of the first flexible jaw set or the second flexible jaw set contacting the second side wall surface of the guide slot of the vice main body on a vertical line, so that the jaw (6) can deflect to the left or right, to be tightly pushed against clamped surfaces (101) of a work piece (10), and the work piece (10) can be stably clamped;

wherein the bottom surface of the jaw (6) is also configured with a slide chamber (63) that can be fitted on the limiting block (8), for the jaw (6) to be fixed on the slide (5);

wherein, a front side inner wall and a rear side inner wall of the slide chamber (63) respectively have a V-shaped containing groove (631) to match the V-shaped stop block (81), and the left side wall and right side wall of the jaw (6) are respectively configured with a through hole (64) that is communicated to the slide chamber (63);

wherein the V-shaped stop block (81) is made up of a first slope (811) extending and protruding toward the lead screw positioning seat (2), and a second slope (812) configured in mirror symmetry relationship to the first slope (811), and the V-shaped containing groove (631) is made up of a first slope inner wall surface (6311) and a second slope inner wall surface (6312) configured to match the first slope (811) and the second slope (812); when the jaw (6) is fitted on the slide (5), the V-shaped stop block (81) is housed inside the V-shaped containing groove (631) and the second slope (812) is pushed against the second slope inner wall surface (6312) of the V-shaped containing groove (631), so that the jaw (6) can be fixed on the slide (5).

2. The vice jaw deflecting structure defined in claim 1, wherein the limiting component (7) is made up of a ball (71) held inside the through hole (64), an elastic body (72) pushed against the ball (71), and a screw locking component (73) contacting the elastic body (72) to press against the elastic body (72).

3. The vice jaw deflecting structure defined in claim 2, wherein the left side wall and right side wall of the limiting block (8) are both configured with a first embedding slot (82) and a second embedding slot (83) in upper and lower arrangements for the ball (71) to slide in and be positioned inside.

4. The vice jaw deflecting structure defined in claim 1, wherein the jaw (6) is an integrally formed L-shaped seat, made up of a clamping seat (65) to be fitted on the slide (5) and a clamping block (66) extending and protruding upward from one side of clamping seat (65), and a notch (67) is formed between the clamping block (66) and the clamping seat (65) to hold the work piece (10).

* * * * *